US010222124B2

(12) United States Patent
Smith

(10) Patent No.: US 10,222,124 B2
(45) Date of Patent: Mar. 5, 2019

(54) STAVE WITH EXTERNAL MANIFOLD

(71) Applicant: BERRY METAL COMPANY, Harmony, PA (US)

(72) Inventor: Todd G. Smith, Harmony, PA (US)

(73) Assignee: Berry Metal Company, Harmony, PA (US)

( * ) Notice: Subject to any disclaimer, the term of this patent is extended or adjusted under 35 U.S.C. 154(b) by 0 days.

(21) Appl. No.: 14/765,281

(22) PCT Filed: Feb. 3, 2014

(86) PCT No.: PCT/US2014/014482
§ 371 (c)(1),
(2) Date: Jul. 31, 2015

(87) PCT Pub. No.: WO2014/121213
PCT Pub. Date: Aug. 7, 2014

(65) Prior Publication Data

US 2015/0377554 A1 Dec. 31, 2015

Related U.S. Application Data

(60) Provisional application No. 61/760,025, filed on Feb. 1, 2013.

(51) Int. Cl.
*F27D 1/12* (2006.01)
*F27D 9/00* (2006.01)
(Continued)

(52) U.S. Cl.
CPC ..... *F27D 1/12* (2013.01); *C21B 7/10* (2013.01); *F27B 1/12* (2013.01); *F27B 1/14* (2013.01);
(Continued)

(58) Field of Classification Search
CPC ... C21B 37/10; F27B 1/12; F27B 1/14; F27D 1/004; F27D 1/04; F27D 1/06; F27D 1/12;
(Continued)

(56) References Cited

U.S. PATENT DOCUMENTS 5,426,664 A * 6/1995 Grove ..... F27B 3/24 110/336
6,870,873 B2 * 3/2005 Lyons ..... F27B 3/085 373/71
(Continued)

FOREIGN PATENT DOCUMENTS

CN 1538135 10/2004
CN 1668879 9/2005
(Continued)

OTHER PUBLICATIONS

Form PCT/ISA/220, PCT Notification of Transmittal of the International Search Report and the Written Opinion of the International Search Authority, or the Declaration, PCT/US2014/014482, dated Sep. 1, 2014.
(Continued)

*Primary Examiner* — Scott R Kastler
*Assistant Examiner* — Michael Aboagye
(74) *Attorney, Agent, or Firm* — Clark Hill PLC

(57) ABSTRACT

A stave comprising an outer housing, an inner pipe circuit comprising individual pipes housed within the outer housing, wherein the individual pipes each has an inlet end and an outlet end and wherein each pipe may or may not be mechanically connected to another pipe, and a manifold, integral with or disposed on or in the housing; wherein the inlet and/or outlet ends of each individual pipe is disposed in or housed by the manifold. The manifold may be made of carbon steel while the housing may be made of copper. Each
(Continued)

of the inlet and outlet ends of each individual pipe may be surrounded in part by cast copper within a housing of the manifold.

20 Claims, 11 Drawing Sheets

(51) Int. Cl.

| | |
|---|---|
| ***F27D 1/00*** | (2006.01) |
| ***C21B 7/10*** | (2006.01) |
| ***F28F 9/02*** | (2006.01) |
| ***F27D 1/04*** | (2006.01) |
| ***F28F 1/00*** | (2006.01) |
| ***F27B 1/12*** | (2006.01) |
| ***F27B 1/14*** | (2006.01) |
| ***F27D 1/06*** | (2006.01) |
| *F28D 7/08* | (2006.01) |
| *F28D 21/00* | (2006.01) |

(52) U.S. Cl.
CPC ..... *F27D 1/004* (2013.01); *F27D 1/04* (2013.01); *F27D 1/06* (2013.01); *F27D 9/00* (2013.01); *F28F 1/00* (2013.01); *F28F 9/02* (2013.01); *F27D 2009/0027* (2013.01); *F27D 2009/0067* (2013.01); *F28D 7/08* (2013.01); *F28D 2021/0056* (2013.01); *F28D 2021/0078* (2013.01)

(58) Field of Classification Search
CPC ..... F27D 2009/0027; F27D 2009/0067; F27D 9/00; F28D 2021/0056; F28D 2021/0078; F28D 7/08; F28F 1/00; F28F 9/02
USPC ..... 266/190, 193, 44, 241, 168; 165/168, 165/169, 170; 29/428
See application file for complete search history.

(56) References Cited

U.S. PATENT DOCUMENTS

| | | | | |
|---|---|---|---|---|
| 2006/0017202 | A1 | 1/2006 | Dratner | |
| 2012/0104670 | A1* | 5/2012 | Smith | F23M 5/02 266/280 |

FOREIGN PATENT DOCUMENTS

| | | | | |
|---|---|---|---|---|
| CN | 102575850 | | 7/2012 | |
| EP | 0025132 | | 3/1981 | |
| EP | 1469085 | | 10/2004 | |
| GB | 1486411 | * | 9/1977 | C21B 7/10 |
| JP | S5633409 | | 4/1981 | |
| WO | WO 98/30345 | | 7/1998 | |
| WO | WO 2011/123579 | | 12/2011 | |
| WO | WO 2013/009824 | | 1/2013 | |

OTHER PUBLICATIONS

Form PCT/ISA/210, PCT International Search Report for International Application No. PCT/US2014/014482, dated Sep. 1, 2014.
Form PCT/ISA/237, PCT Written Opinion of the International Searching Authority for International Application No. PCT/US2014/014482, dated Sep. 1, 2014.
Bonte L et al: "Installing Copper Staves and Blast Furnace Operating Practice at Sidmar", AISE Steel Technology, AISE, Pittsburgh, PA, US, vol. 76, No. 6, Jun. 1, 1999, (Jun. 1, 1999), pp. 43-50, XP000834866, ISNN: 0021-1559 figure 11; table V.

* cited by examiner

STAVE WITH EXTERNAL MANIFOLD

RELATED APPLICATIONS

This application claims priority benefit under 35 U.S.C. § 119(e) of U.S. Provisional Application No. 61/760,025, filed Feb. 1, 2013, the contents of which are herein incorporated by reference.

TECHNICAL FIELD

The present disclosure relates generally to apparatus and methods for constructing and installing bricks, such as refractory bricks, in frames, staves and/or coolers in blast furnaces or other metallurgical furnaces. Related fields include systems and methods for cooling blast furnaces and other metallurgical furnaces. Related fields include cooling plates and cooling staves.

BACKGROUND

Field of the Disclosure

Conventional designs and constructions for cooling refractory bricks in blast furnaces and other metallurgical furnaces include cooling staves.

Conventional cooling staves are difficult to install in a furnace since they require multiple access holes or apertures in the furnace shell necessary for the inlet/outlet piping to and from stave through furnace shell.

Further, conventional cooling staves are relatively weak in that they are highly susceptible to the effects of expansion/contraction due to temperature changes in the furnace, particularly the effects thereof, such as weld breaches, on the individual pipe connections between the stave and the furnace shell.

Conventional cooling staves have a high number of important and/or critical support bolts needed to help support stave on furnace shell.

Conventional copper cooling staves are generally planar, rectangularly shaped and arranged within a furnace substantially parallel or as parallel as possible, given the shapes of the staves and/or the interior of the furnace, to the metal shell of the furnace. The cooling staves typically cover a high percentage of the inner surface of the metal shell of the furnace. Refractory lining, such as refractory bricks, may be disposed in, on or around the surface of the stave, such as, for example, bricks disposed within slots or channels defined by the stave. Staves also have cavities that provide passages or house internal piping. Such passages or piping are connected to one or more external pipes that extend from the furnace shell side of the stave and penetrate the metal shell of the furnace. Coolant, such as, for example, water at an elevated pressure is pumped through the pipes and passages in order to cool the stave. The cooled stave thus cools the refractory bricks disposed within slots or channels defined by the stave.

Current stave or cooling panel brick designs typically are installed in grooves or channels in the cooler before installing the cooling stave/panel in the furnace. Further, many conventional refractory bricks are designed to be installed in a flat stave or cooler. When using flat or curved staves/coolers with pre-installed bricks, the staves are installed in the furnace and have a ram gap in between each pair of adjacent staves to allow for construction deviation. These ram gaps are then filled with refractory material to close the gap between the stave/brick constructions on the sides of the gap. This refractory filled ram gap typically is a weak point in a furnace lining comprising conventional stave/brick constructions. During furnace operation, the ram gap often erodes prematurely and furnace gases track between the staves. Moreover, such conventional stave/brick constructions leave brick edges protruding into the furnace which are exposed to matter and other debris falling through the furnace. Such protruding brick edges tend to wear out more frequently than non-protruding edges, leading to broken or crumbled bricks that may fall through the furnace causing further damage to the furnace lining. Such broken bricks also expose the stave thereby causing it to be damaged or worn out prematurely.

Current stave or cooling panel bricks are typically either installed in straight grooves employed as the main method of attachment to keep the bricks in the cooler or tapered to force bricks which are not locked in grooves in the stave to push against the cooler when the bricks are heated during furnace operation.

Also, in recent years, it has been a common practice to install staves without refractory in front of them and try to form a skull layer to protect and insulate the stave in a blast furnace. This process related skull is generated and lost repeatedly in service and actually changes furnace performance. Skulls can only be formed in the cohesive zones of the furnace. Therefore, this skull approach is not effective if the cohesive zone is incorrectly determined. Additionally, the cohesive zone of the furnace changes depending on charge material and the skull adhesion is lost in sections of the furnace at different times. This results in non-uniform temperatures throughout the staves and furnace. However, an improved brick refractory lining protects the stave regardless of adhesion and would be preferable to such skull insulating process, even through in some cases it may still be desirable to form the skull to protect the improved refractory.

Current locked-in brick designs, such as dovetailed bricks in complementary-shaped stave channels, are relatively thin throughout their vertical thickness. Such thin-necked bricks are susceptible to cracking at the thin neck portion thereby creating brick fragments and pieces falling into the furnace which may hit and damage other bricks and staves of the furnace lining.

Many older stave designs which incorporate bricks in front of the stave employ multiple rows or layers of bricks in front of the stave. Such constructions contain joints which further prevent effective cooling of the bricks farthest from the stave.

As listed above, many shortcomings are associated with known stave and refractory brick constructions.

Accordingly, it would be desirable to provide a stave having many advantages over conventional staves, such as: (1) a stave that provides for ease of installation since it reduces the number of access holes or apertures required in the furnace shell necessary for the inlet/outlet piping to and from stave through furnace shell; (2) a stave having an external manifold that provides much of the support necessary for installation of the stave on furnace shell; (3) a stave that minimizes the effects of stave expansion/contraction due to temperature changes in the furnace since individual pipe connections to furnace shell have been eliminated; (4) a stave that reduces weld breaches in pipe connections with furnace shell since such connections have been eliminated; (5) a stave that reduces the importance/criticality of any support bolts needed to help support stave on furnace shell since such bolts are no longer relied upon to independently support stave since an external manifold carries much of the load required to support stave on furnace shell.

Accordingly, it would also be desirable to provide a stave with an external manifold in which the refractory bricks may be installed in a flat or curved stave or cooler, before or after the stave cooler is installed in a furnace. Additionally, in the event of a reworking or rebuilding of the stave/brick construction in the furnace, the refractory bricks of the present disclosure can be replaced or re-installed in-whole or in-part, without removing the stave or cooler from the furnace.

In addition, it would be desirable to provide a stave with an external manifold which provides a continuous lining around the interior circumference of the furnace that eliminates ram gaps between the bricks of adjacent staves and thereby increases the integrity and life of the furnace lining.

Further, it would be desirable to provide a stave/brick construction ideal for use in blast furnaces in which no brick edges are exposed or protrude into the furnace to increase the life and integrity of the furnace lining.

In addition, it would be desirable to provide a stave with an external manifold in which the refractory bricks can be installed in a stave or cooler that is tilted on an angle with the bricks staying in the grooves in such stave or cooler and in which the bricks may be inserted and/or removed from the front face of the stave before and/or after the stave is installed in the furnace.

Furthermore, it would be desirable to provide a stave with an external manifold in which the refractory bricks are doubly locked into the channels in the stave (1) by complementary surfaces of the bricks and stave channels that are engaged by inserting a portion of each brick into a channel or groove in the stave and simultaneously or thereafter rotating each brick on an axis substantially parallel to a plane of the stave and/or (b) such that the bottom of the brick rotates in a direction towards or substantively towards the stave in order to engage such complementary surfaces of the channel and brick in order to secure or lock the brick into the channel chamber and prevent it from moving linearly out of the channel or groove through an opening in the front face of the stave and (2) by oblique or tapered sections of the bricks that expand when heated during furnace operation, and push against the stave or cooler to maintain an effective bond therewith thereby providing highly effective cooling of the bricks, while also holding in place any bricks that might crack or break.

Moreover, it would be desirable to provide a stave with an external manifold in which the stave surface temperature is uniform and which allows for more consistent furnace operation with less loss of heat to thereby reduce stresses on the furnace and staves and increase the life of both.

These and other advantages of the invention will be appreciated by reference to the detailed description of the preferred embodiment(s) that follow.

BRIEF SUMMARY OF THE DISCLOSURE

In a preferred aspect, the present disclosure comprises a stave comprising an outer housing, an inner pipe circuit comprising individual pipes housed within the outer housing, wherein the individual pipes each has an inlet end and an outlet end and wherein each pipe may or may not be mechanically connected to another pipe, and a manifold, integral with or disposed on or in the housing; wherein the inlet and/or outlet ends of each individual pipe is disposed in or housed by the manifold.

In accordance with yet another aspect of the stave of the present disclosure, the manifold preferably may be made of carbon steel and the housing preferably may be made of copper.

In yet another aspect of the stave of the present disclosure, the manifold houses the inlet and outlet ends of each individual pipe.

In yet a further aspect of the stave of the present disclosure, the manifold is made of carbon steel and the housing is made of copper, the manifold houses the inlet and outlet ends of each individual pipe and wherein each of the inlet and outlet ends of each individual pipe is surrounded in part by cast copper within a housing of the manifold.

In another preferred first aspect, the present disclosure comprises a stave comprising an outer housing, an inner pipe circuit comprising individual pipes housed within the outer housing, wherein the individual pipes each has an inlet end and an outlet end and wherein each pipe may or may not be mechanically connected to another pipe, and a manifold, integral with or disposed on or in the housing; wherein the inlet and/or outlet ends of each individual pipe is disposed in or housed by the manifold. Further, the stave has a plurality of ribs and a plurality of channels, wherein a front face of the stave defines a first opening into each of the channels; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated.

In yet a further aspect of the stave of the present disclosure, the stave defines one or more side openings into each of the channels.

In another aspect of the stave of the present disclosure, the one or more portions of the brick comprises a nose at least partially disposed in a first section of the one channel.

In yet a further aspect of the stave of the present disclosure, the first section is complementary to the nose.

In another aspect of the stave of the present disclosure, the rotation of the brick comprises a bottom of the brick moving in a direction towards the stave.

In yet a further aspect of the stave of the present disclosure, a first rib surface of the first rib is complementary to a groove defined by a top of the brick and wherein the first rib surface is at least partially disposed in the groove.

In another aspect of the stave of the present disclosure, each of the plurality of bricks can be removed from its respective channel via rotation of each brick comprising a bottom of each brick moving in a direction away from the stave.

In yet a further aspect of the stave of the present disclosure, the stave is substantially flat.

In another aspect of the stave of the present disclosure, the stave is curved with respect to one or both of a horizontal axis and a vertical axis.

In yet a further aspect of the stave of the present disclosure, the plurality of bricks at least partially disposed in the plurality of channels form a plurality of stacked, substantially horizontal rows of bricks protruding from the front face of the stave.

In another aspect of the stave of the present disclosure, one of the bricks cannot be pulled and/or rotated out of the first opening of its respective channel when another brick is disposed in the row above and partially or completely covers the one brick.

In yet a further preferred aspect, the stave of the present disclosure further comprises a plurality of staves standing side-by-side with gaps between adjacent staves; wherein each stave has a plurality of ribs, a plurality of channels, and a plurality of substantially horizontal rows of bricks disposed in the plurality of channels.

In another aspect of the stave of the present disclosure, the plurality of substantially horizontal rows of bricks disposed in the plurality of channels covers, in-whole or in-part, the gaps between adjacent staves.

In yet a further preferred aspect, the staves stand substantially vertically or at an angle other than about 90 degrees.

In another aspect of the stave of the present disclosure, each of the plurality of bricks further defines a seat wherein the seat is at least partially disposed in a second section of the one channel.

In another aspect of the stave of the present disclosure, the second section is complementary to the seat.

Many other variations are possible with the present disclosure, and those and other teachings, variations, and advantages of the present disclosure will become apparent from the description and figures of the disclosure.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION OF PREFERRED EMBODIMENT(S) OF THE DISCLOSURE

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "disclosure" merely for convenience and without intending to voluntarily limit the scope of this application to any single inventive concept if more than one is in fact disclosed.

The following description is, therefore, not to be taken in a limited sense, and the scope of the inventive subject matter is defined by the appended claims and their equivalents.

Figure 1:
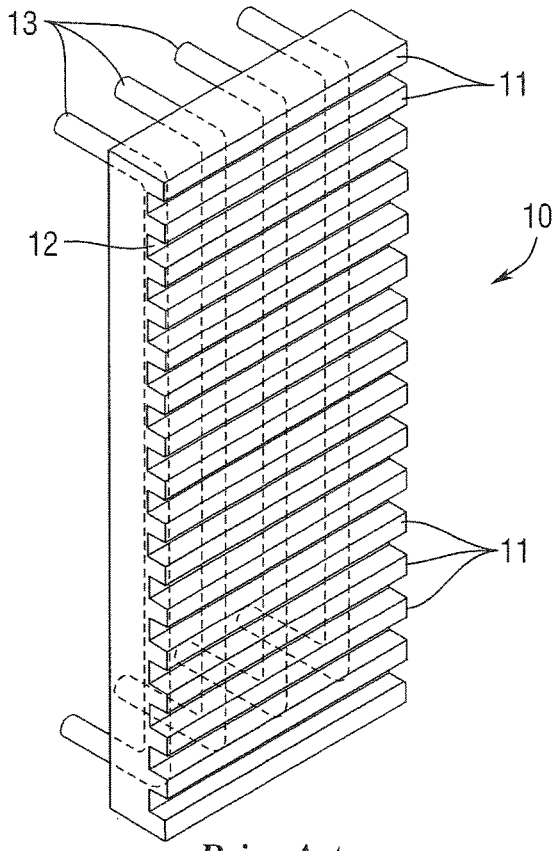
Prior Art Fig.1
FIG. 1 is a front perspective view of a conventional stave.

FIG. 1 illustrates a planar, fluid cooled stave 10 of known construction having a plurality of stave ribs 11 and defining a plurality of stave channels 12, both of generally rectangular cross-sections for use with bricks having matching cross-sections. Other stave designs of known construction (not shown) employ stave ribs and stave channels having cross-sections complementary to the dovetail sections 16 of the conventional refractory brick 14 shown in FIG. 2 to allow such dovetailed sections 16 thereof to be inserted into the side ends of the stave and slid into position therein with or without mortar in between each adjacent brick. A major disadvantage of such known stave/brick constructions is that due to the closeness to each other when installed in a furnace, such staves 10 must be removed from the furnace to allow the bricks 14 to be slid out of the stave channels 12 whenever the stave/brick construction needs to be rebuilt or repaired, either in-whole or in-part. Removing such staves 10 from the furnace is necessitated because bricks 14 cannot be removed or inserted into stave channels 12 through the front face of stave 10. As shown in FIG. 1, stave 10 comprises a plurality of pipes 13 disposed inside the stave 10 which may be connected to one or more external pipes that extend from the furnace shell side of the stave 10 and penetrate the metal shell of the furnace so that coolant, such as, for example, water at an elevated pressure is pumped through the pipes 13 in order to cool the stave 10 and any refractory bricks disposed within stave channels 12 when assembled and installed in a furnace.

Figure 2:
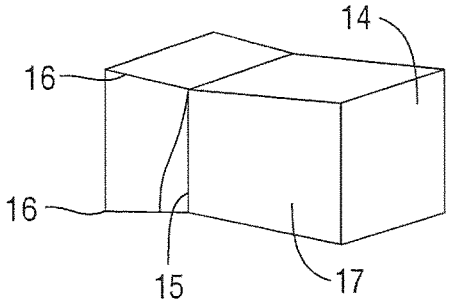
Prior Art Fig.2
FIG. 2 is a side perspective view of a conventional, dove-tailed refractory brick.

As further illustrated in FIG. 2, conventional dovetailed refractory brick 14 has a relatively thin vertical neck 15 which is susceptible to breakage in the furnace environment, particularly where the length of protruding portion 17 of brick 14 which protrudes into the furnace from stave 10 is long relative to the overall depth or length of brick 14.

Figure 3:
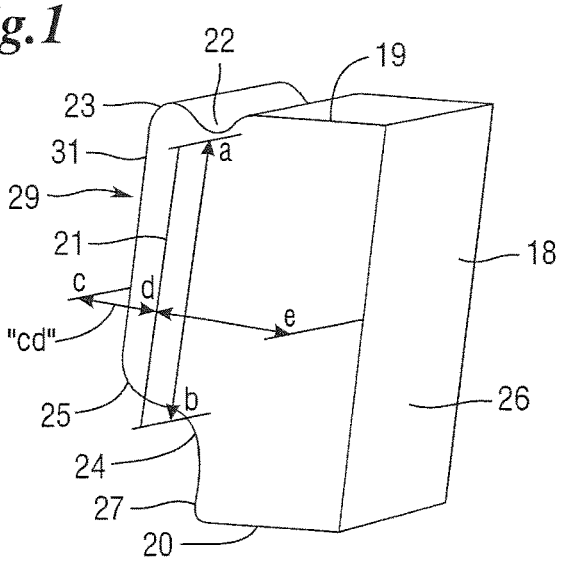
FIG. 3 is a side perspective view of a brick according to a preferred embodiment of the present disclosure.
Figure 4:
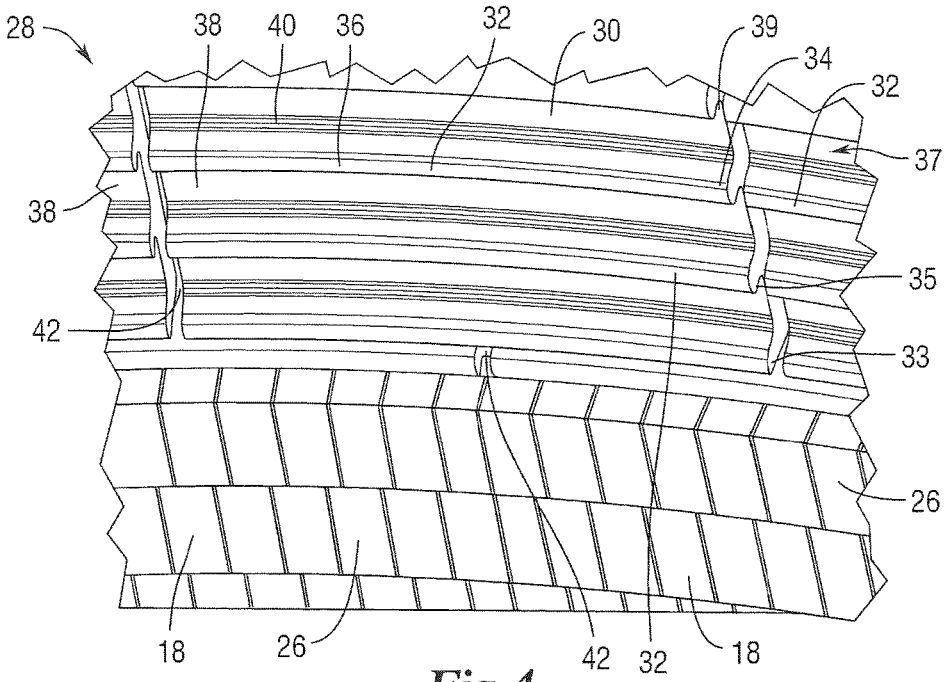
FIG. 4 is a top perspective view of a preferred embodiment of a furnace lining of the present disclosure comprising a preferred embodiment of a stave/brick construction of the present disclosure employing the brick of FIG. 3.

FIG. 3 illustrates a preferred embodiment of a refractory brick 18 according to a preferred embodiment of a stave/brick construction 28 of the present disclosure. Brick 18 has an exposed face 26 and oblique or slanted top and bottom sections 19 and 20, respectively. Brick 18 also comprises or defines a locking side 29 comprising concave groove 22, a generally arcuate nose 23, a generally arcuate seat 25, a generally arcuate concave section 24, a lower face 27 and a generally planar front face 31. Brick 18 also has a neck 21, the vertical thickness ("ab") of which is increased with respect to the vertical neck 15 of known bricks 14. Preferably, the length "ab" of vertical neck 21 is equal to or greater than about two (2) times the length "cd" of the depth of brick 18 that is disposed in stave channel 37 when the brick 18 is installed therein. The shapes, geometries and/or cross-sections of brick 18 and/or any part thereof, including, without limitation, one or more of exposed face 26, lower face 27, front face 31, oblique/slanted top section 19, oblique/slanted bottom section 20, groove 22, nose 23, seat 25, concave section 24 and front locking side 29 may be modified or take other forms such as being angular, rectilinear, polygonal, geared, toothed, symmetrical, asymmetrical or irregular instead the shapes of the preferred embodiments thereof as shown in the drawings hereof without departing from the scope of the disclosure hereof. The refractory bricks 18 of the present disclosure preferably may be constructed from many of the refractory materials currently available including, but not limited to, silicon carbide (such as Sicanit AL3 available from Saint-Gobain Ceramics), MgO—C (magnesia carbon), alumina, insulating fire brick (IFB), graphite refractory brick, cast iron and carbon. In addition, bricks 18 may be constructed from alternating or different materials depending upon their location in a stave 30 or within the furnace. Also, as set forth above, the shape of bricks 18 may also be modified or altered to meet various stave and/or furnace spaces and/or geometries.

Preferred embodiments of a stave/refractory brick construction 28 of the present disclosure is shown in FIGS. 3-8 and 10, including a preferred embodiment of a stave 30 of the present disclosure. Stave 30 may comprise a plurality of pipes (not shown), such as the pipes 13 disposed inside the stave 10 as shown in FIG. 1, which may be attached to one or more external pipes that extend from the furnace shell side of the stave 30 and penetrate the metal shell of the furnace so that coolant, such as, for example, water at an elevated pressure is pumped through such pipes (not shown) in order to cool the stave 30 and any refractory bricks 18 disposed within stave channels 37 thereof when assembled and installed in a furnace. Preferably, the stave 30 is constructed of copper, cast iron or other metal of high thermal conductivity, while any pipes disposed with stave 30 are preferably made from steel.

Each stave 30 preferably may be curved about its horizontal axis and/or about its vertical axis to match the internal profile of the furnace or area in which they will be used. Each stave 30 preferably comprises a plurality of stave ribs 32 and a stave socle 33 to support stave 30 in a standing position which may be a fully upright 90 degrees as shown, or a tilted or slanted position (not shown). Each stave rib 32 preferably defines a generally arcuate top rib section 34 and a generally arcuate bottom rib section 35. Stave 30 preferably defines a plurality stave channels 37 between each successive pair of stave ribs 32. Preferably, each stave channel 37 is generally "C-shaped" or "U-shaped" and includes a generally planar stave channel wall 38, although stave channel wall 38 may also be curved or contoured along its vertical and/or horizontal axes, toothed, etc., to be complementary with the front face 31 of brick 18 if such front face 31 has a shape other than the planar shape depicted herein, which may depend upon the application. Each stave channel 37 also preferably includes a generally arcuate upper channel section 39 and a generally arcuate lower channel section 40, all as defined by stave 30 and a successive pair of stave ribs 32. The shapes, geometries and/or cross-sections of one or more of the stave ribs 32, top rib sections 34, bottom rib sections 35, stave channels 37, stave channel walls 38, upper channel sections 39 and lower channel sections 40, preferably may be modified or take other forms such as being contoured, angular, rectilinear, polygonal, geared, toothed, symmetrical, asymmetrical or irregular instead the shapes of the preferred embodiments thereof as shown in the drawings hereof without departing from the scope of the disclosure hereof.

Figure 5:
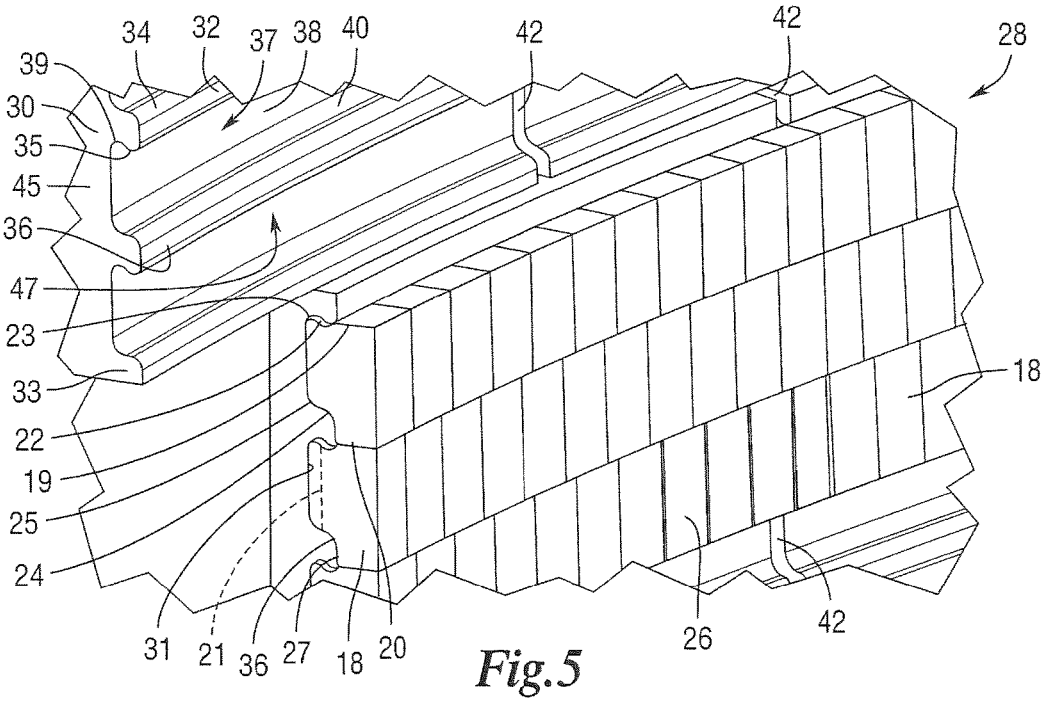
FIG. 5 is a side perspective view of a preferred embodiment of a furnace lining of the present disclosure comprising a preferred embodiment of a stave/brick construction of the present disclosure employing the brick of FIG. 3.
Figure 6:
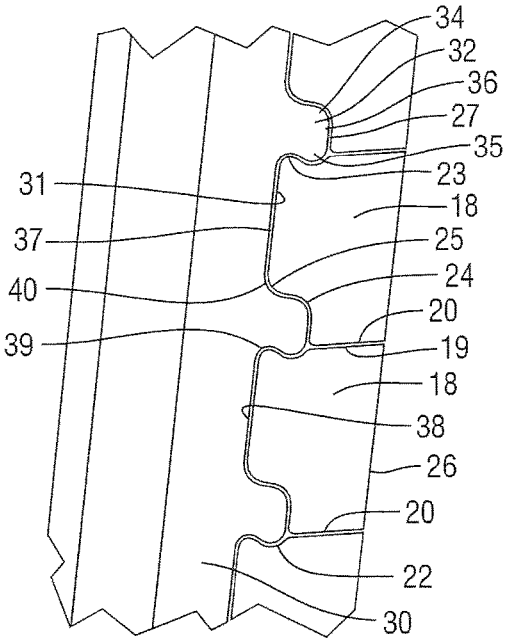
FIG. 6 is a cross-sectional view of a preferred embodiment of a stave/brick construction of the present disclosure employing the brick of FIG. 3.
Figure 7:
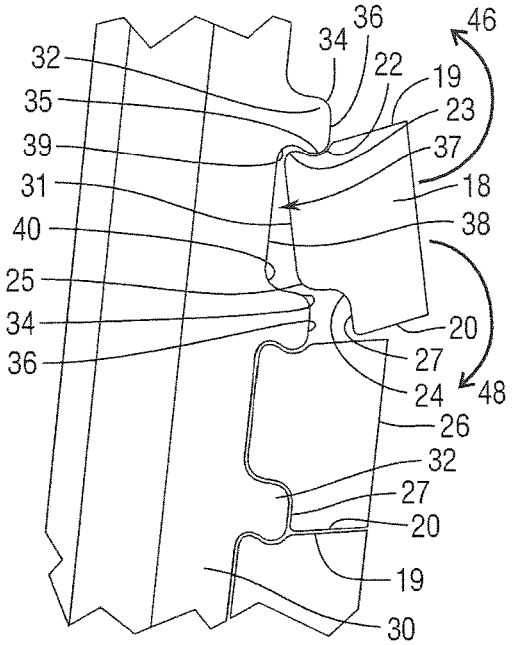
FIG. 7 is a cross-sectional view of a preferred embodiment of a stave/brick construction of the present disclosure showing the brick of FIG. 3 as it is being inserted or removed from a front face of a preferred embodiment of a stave of the present disclosure.

As shown in FIGS. 6 and 7, while the stave bricks 18 of the present disclosure may be slid into stave channels 37 from the sides 45 of stave 30 when space permits, stave bricks 18 may also preferably and advantageously be inserted into the front face 47 of staves 30. Beginning at the bottom of stave 30, each stave channel 37 may be filled with stave bricks 18 by rotating or tilting each brick 18 in a first direction 46 where the bottom portion of brick 18 moves away from stave 30 preferably (1) about an axis substantially parallel a plane of the stave or (2) to allow nose 23 to be inserted into stave channel 37 and into concave, arcuate upper channel section 39, after which brick 18 is rotated in a second direction 48 generally such that the bottom of brick 18 moves toward stave 30 until (i) nose 23 is disposed in-whole or in-part within concave, arcuate upper channel section 39 with or without the perimeter of nose 23 being in partial or complete contact with upper channel section 39, (ii) front face 31 of brick 18 is disposed substantially near and/or adjacent to channel wall 38 with or without the front face 31 being in partial or complete contact with channel wall 38, (iii) arcuate seat 25 is disposed in-whole or in-part within arcuate lower channel section 40 with or without the perimeter of seat 25 being in partial or complete contact with lower channel section 40, (iv) arcuate concave section 24 is disposed in-whole or in-part over the arcuate top rib section 34 of the lower stave rib 32 of the successive pair of stave ribs 32 defining the stave channel 37 into which the brick 18 is being inserted with or without the inside surface of concave section 24 being in partial or complete contact with the arcuate top rib section 34 of such lower stave rib 32, (v) lower face 27 of brick 18 is disposed substantially near and/or adjacent to rib face 36 with or without the lower face 27 being in partial or complete contact with rib face 36, and/or (vi) slanted bottom section 20 of the brick 18 being installed is disposed substantially near and/or adjacent to slanted top section 19 of the brick 18 immediately below the brick 18 being installed with or without such slanted bottom section 20 being in partial or complete contact with such slanted top section 19, in the case where the brick 18 is being installed in any of the stave channels 37 except the lowest stave channel 37 of stave 30. As illustrated in FIGS. 5-7, when the nose 23 is disposed in-whole or in-part within concave, arcuate upper channel section 39 with or without the perimeter of nose 23 being in partial or complete contact with concave, upper channel section 39, and/or arcuate seat 25 is disposed in-whole or in-part within concave, arcuate lower channel section 40 with or without the perimeter of seat 25 being in partial or complete contact with concave, lower channel section 40, each of the bricks 18 is prevented from being moved linearly out of stave channel 37 through the opening in the front face 47 of stave 30 without each brick 18 being rotated such that the bottom thereof is rotated away from the front face 47 of stave 30.

As also shown in FIGS. 5-8, once a row of bricks 18 is installed in a stave channel 37 above a row of previously installed bricks 18, the bricks 18 in such immediately lower row are locked into place and cannot be rotated in the first direction 46 away from stave 30 to be removed from stave channel 37. The stave/refractory brick construction 28 of the present disclosure as shown in FIGS. 3-7 and 10 may be employed with or without mortar between adjacent stave bricks 18.

Figure 8:
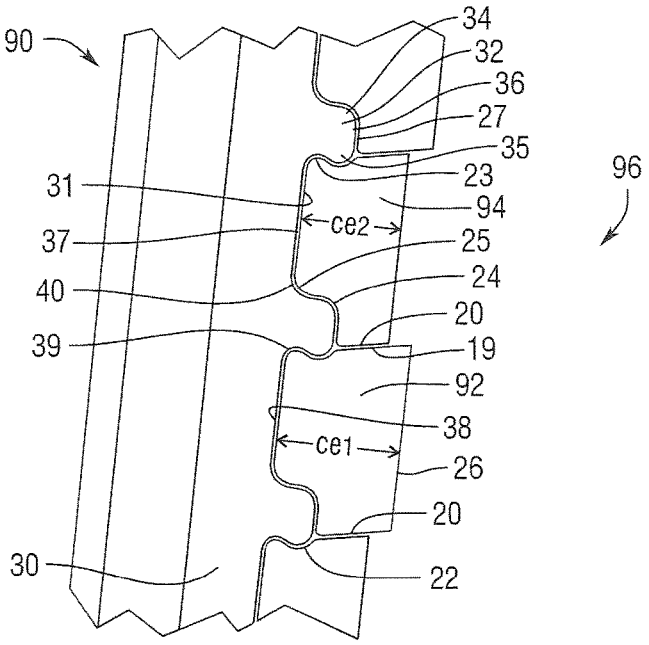
FIG. 8 is a cross-sectional view of a preferred embodiment of an alternative stave/brick construction of the present disclosure employing at least two different sizes of the bricks of FIG. 3.

FIG. 8 illustrates another preferred embodiment of a stave/brick construction 90 of the present disclosure which is the same as stave/brick construction 28 of FIGS. 4-7 except that it employs at least two different sizes of stave bricks 92 and 94, respectively, to form an uneven front face 96. As shown, bricks 92 of the stave/brick construction 90 have a greater overall depth "ce1" than the depth "ce2" of bricks 94. This staggered construction resulting from the different depths of stave bricks 92 and 94, respectively, may preferably be used in accretion zones or other desirable zones of the furnace where the uneven front face 96 would be more effective at holding an accretion or buildup of material to further protect the bricks 92 and 94 from thermal and/or mechanical damage.

Figure 9:
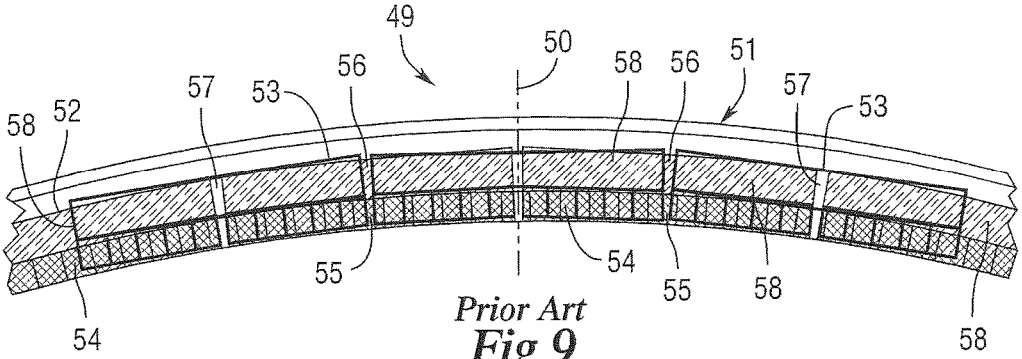
Prior Art Fig.9
FIG. 9 is a top plan view of a conventional furnace lining employing conventional stave/brick constructions.
Figure 10:
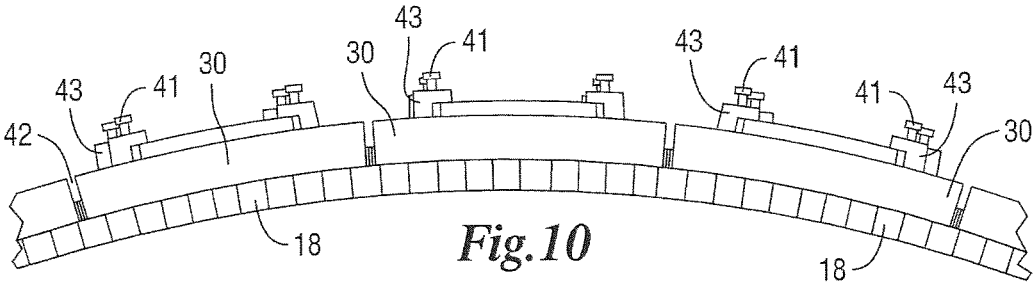
FIG. 10 is a top plan view of a preferred embodiment of a furnace lining of the present disclosure comprising a preferred embodiment of a stave/brick construction of the present disclosure employing the brick of FIG. 3.

FIG. 9 illustrates the use of conventional stave/brick constructions 58 within a furnace 49. When using flat or curved staves/coolers, such as the flat/planar upper and lower staves 52 and 53, respectively, with pre-installed bricks 54 arranged within furnace shell 51, such staves 52 and 53 are installed in the furnace 49 such that ram gaps 56 exist in between adjacent pairs of upper staves 52 and such that ram gaps 57 exist in between adjacent pairs of lower staves 53, both to allow for construction allowance. These ram gaps 56 and 57 must be used to allow for construction deviation. Such ram gaps 56 and 57 are typically rammed with refractory material (not shown) to close such gaps 56 and 57 between the adjacent stave/brick constructions 58. Such material filled gaps 56 and 57 typically are weak points in such conventional furnace linings using stave/brick constructions 58. During operation of furnace 49, the rammed gaps 56 and 57 erode prematurely and furnace gases track between the stave/brick constructions 58. With the preferably curved stave/brick constructions 28 of the present disclosure, the furnace can be bricked continuously around its circumference to eliminate conventional rammed gaps with bricks 18. As shown in FIG. 10, the gaps 42 between staves 30 are covered by one or more of bricks 18 of the present disclosure, eliminating the need for ramming filling material into such gaps 42. By eliminating the conventional rammed gaps 56 and 57 between the furnace bricks of adjacent staves 30, the integrity and life of the furnace and/or furnace lining is increased.

Another problem associated with the conventional stave/brick constructions 58 having pre-installed bricks 54, as shown in FIG. 9, is that because such conventional stave/brick constructions 58 are not continuously bricked around the circumference of furnace 49, edges 55 of numerous of the bricks 54 protrude into the interior of furnace 49 and are thus exposed to any matter falling through the furnace 49. Such protruding edges 55 tend to wear faster and/or are susceptible to being hit by falling matter, causing such bricks 54 with protruding edges 55 to break off into the furnace 49 and expose the staves 52 and 53. Again, the stave/brick constructions 28 of the present disclosure allow the furnace to be bricked continuously around its circumference thereby eliminating any such protruding brick edges 55, as shown in FIG. 10. Thus, the occurrences of (i) bricks 18 being pulled or knocked out of staves 30 and (ii) of staves 30 being directly exposed to the intense heat of the furnace are both significantly reduced by the stave/brick construction 28 of the present disclosure. Such characteristics make the stave/brick construction 28 of the present disclosure well-suited for use in the stack of blast furnaces.

As also shown in FIG. 10, a plurality of pin mounting cylinders 43 are preferably formed on the back side of each stave 30 for mounting pins 41 used to handle each stave 30, and/or to secure and/or mount each stave 30 within a furnace. Each of the pins 41 preferably defines a threaded or unthreaded thermocouple mounting hole (not shown) allowing one or wore thermocouples to be easily installed at various locations on each stave 30.

While the preferred embodiment of a stave/refractory brick construction 28 of the present disclosure shown in FIGS. 3-8 and 10, includes a preferred embodiment of a furnace cooler or stave 30, the teachings of the present disclosure are also applicable to a frame/brick construction where such frame (not shown) is not limited to a furnace cooler or stave 30, but is a frame for providing a standing or other supported vertical or slanted wall of bricks, whether or not refractory bricks, for applications including, but not limited to, furnace applications.

Figure 11:
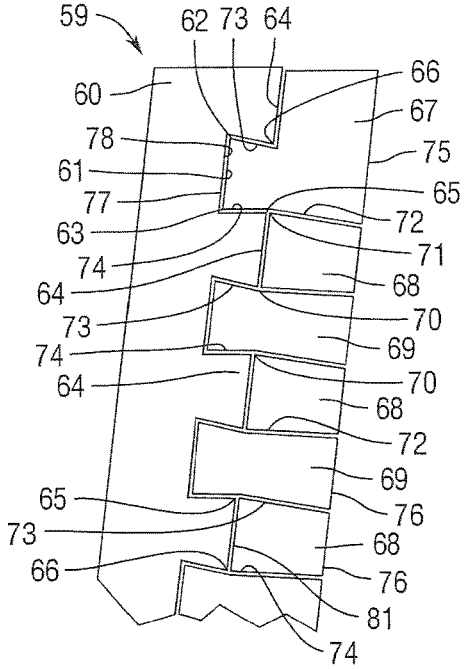
FIG. 11 is a cross-sectional view of another preferred embodiment of a stave/brick construction of the present disclosure.
Figure 12:
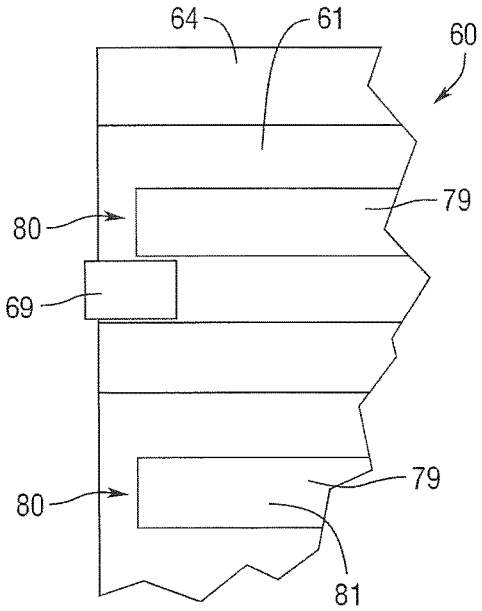
FIG. 12 is a partial, front elevational view of the stave/brick construction of FIG. 11.
Figure 13:
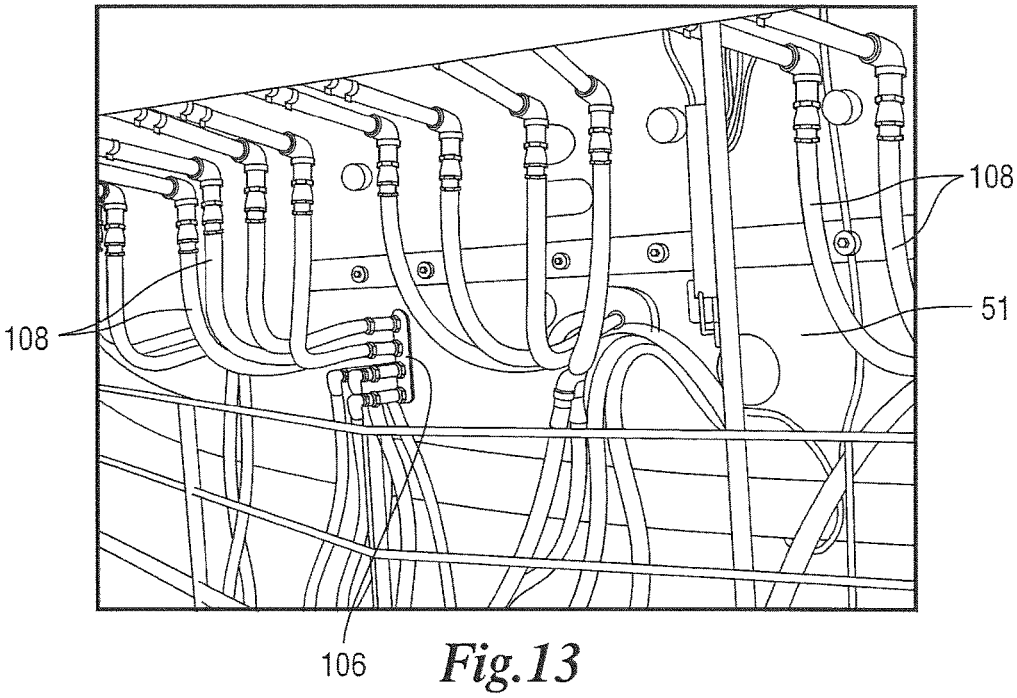
FIG. 13 is a front perspective view of a furnace having installed therein preferred staves having an external manifolds of the present disclosure.
Figure 14:
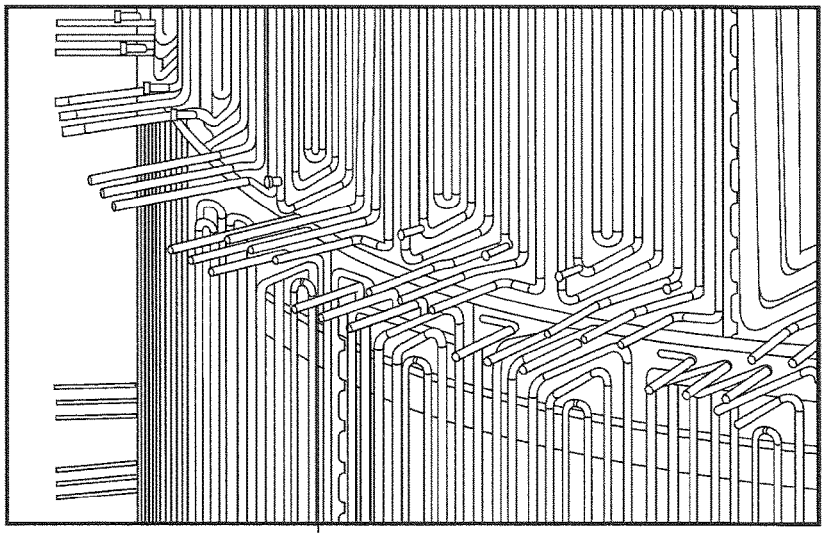
FIG. 14 is a schematic view of a furnace having installed thereon conventional staves having multiple inlet/outlet pipes and thus requiring multiple access holes or apertures in the furnace shell.
Figure 15:
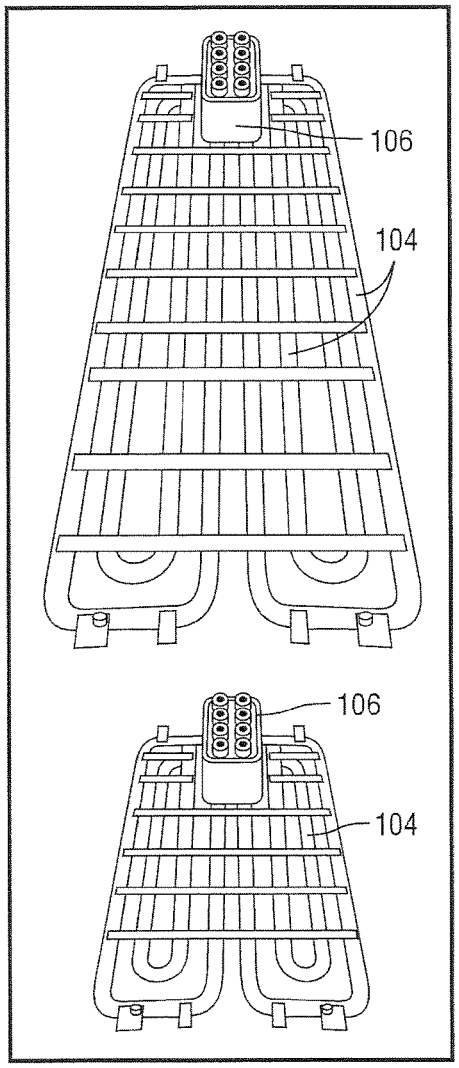
FIG. 15 shows views of preferred internal coil assemblies for preferred staves of the present disclosure having external manifolds.
Figure 16:
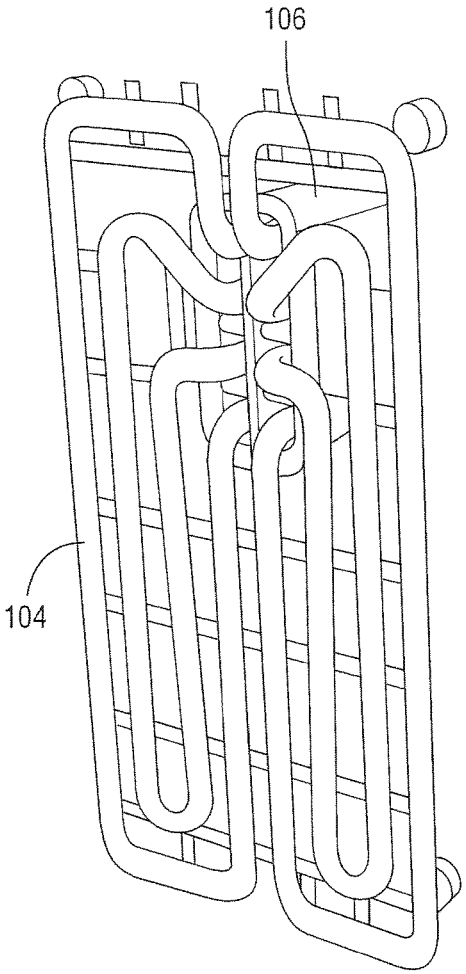
FIG. 16 shows another view of a preferred internal coil assembly for a preferred stave of the present disclosure having an external manifold.
Figure 17:
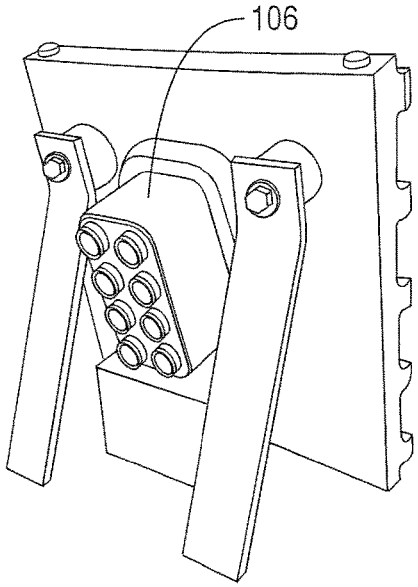
FIG. 17 shows a rear perspective view of a preferred stave of the present disclosure having an external manifold.
Figure 18:
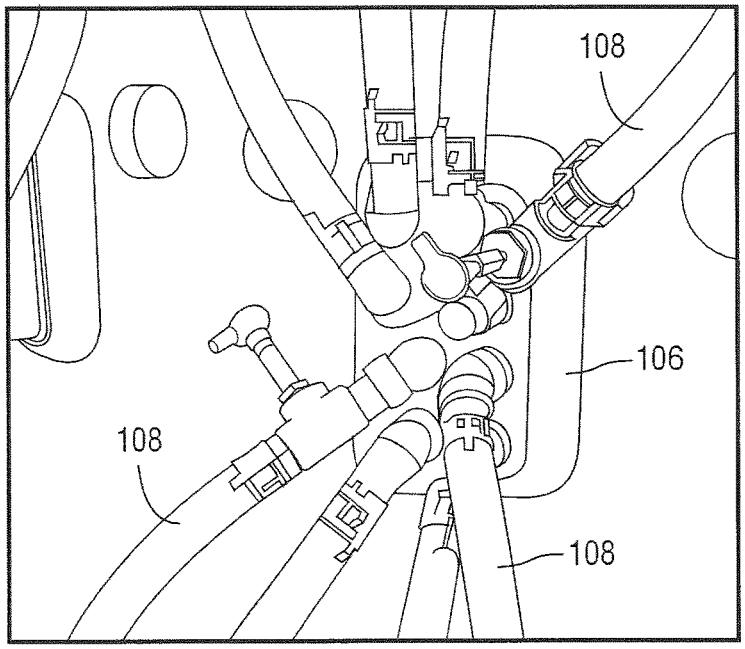
FIG. 18 shows a rear perspective view of a preferred stave of the present disclosure having an external manifold with coolant fluid inlet and outlet hoses connected thereto.
Figure 19:
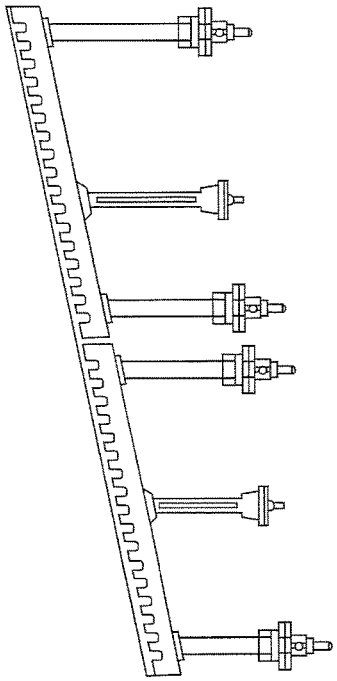
FIG. 19 is a cross-sectional view of conventional staves having multiple inlet/outlet pipes and thus requiring multiple access holes or apertures in the furnace shell.
Figure 20:
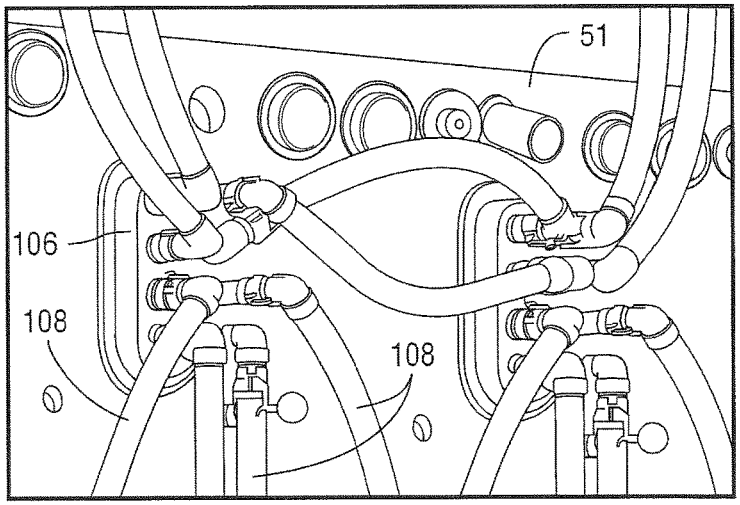
FIG. 20 shows a rear perspective view of preferred staves of the present disclosure installed in a furnace with the external manifolds thereof extending through the furnace with coolant fluid inlet and outlet hoses connected thereto.
Figure 21:
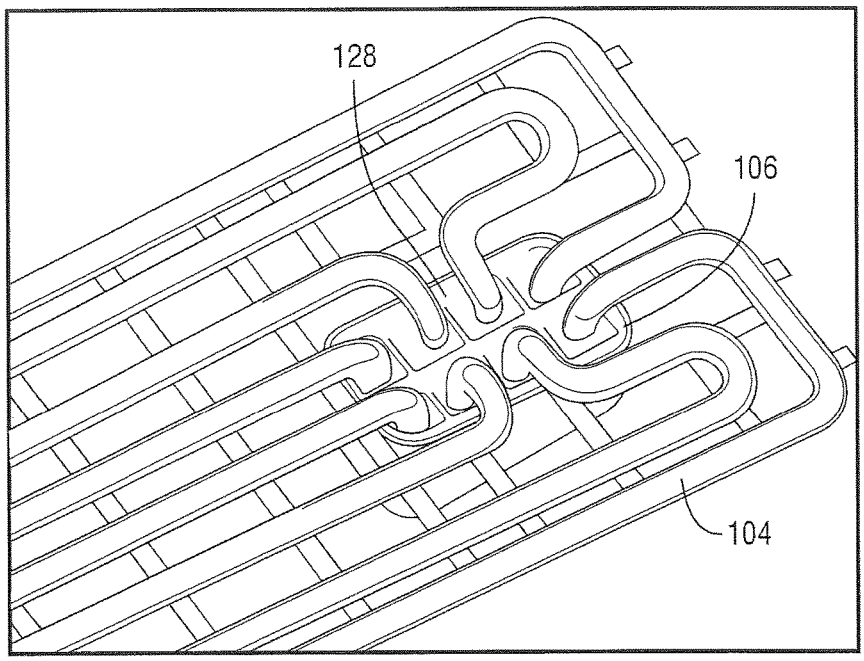
FIG. 21 shows an expanded, front perspective view of a preferred internal coil assembly for a preferred stave of the present disclosure having an external manifold.
Figure 22:
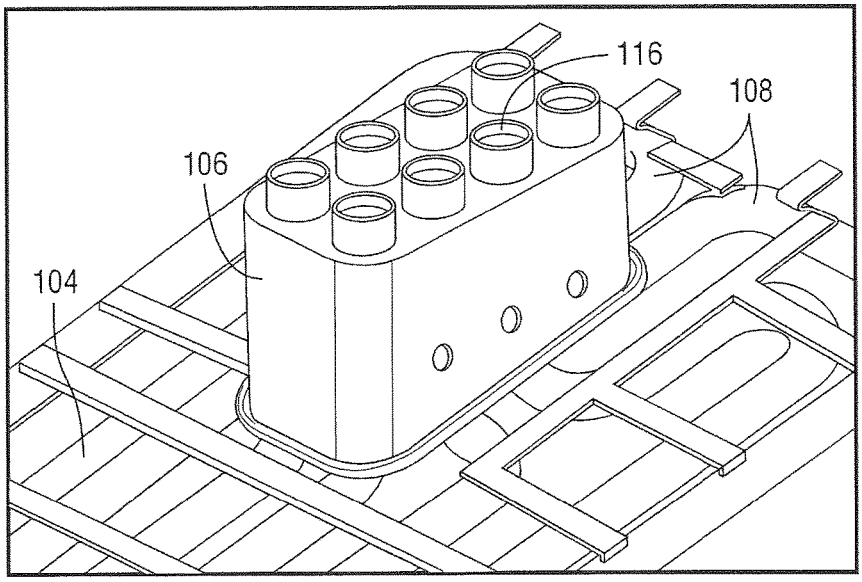
FIG. 22 shows an expanded, rear perspective view of a preferred internal coil assembly for a preferred stave of the present disclosure having an external manifold.
Figure 23:
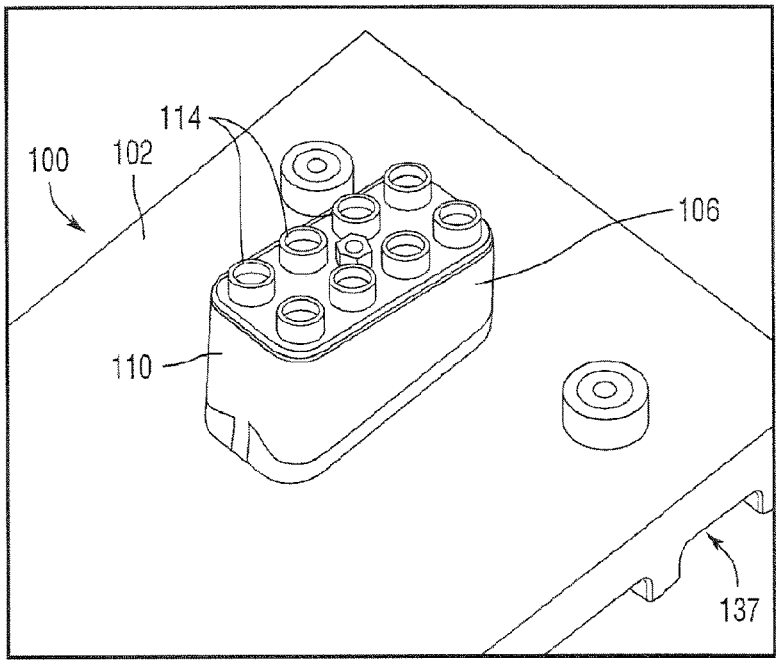
FIG. 23 shows an expanded, rear perspective view of a preferred stave of the present disclosure having an external manifold.
Figure 24:
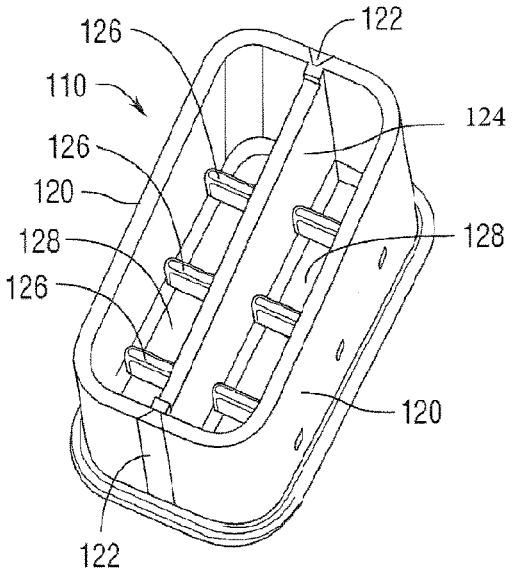
FIG. 24 shows an expanded, rear perspective view of a manifold housing of a preferred stave of the present disclosure having an external manifold.
Figure 25:
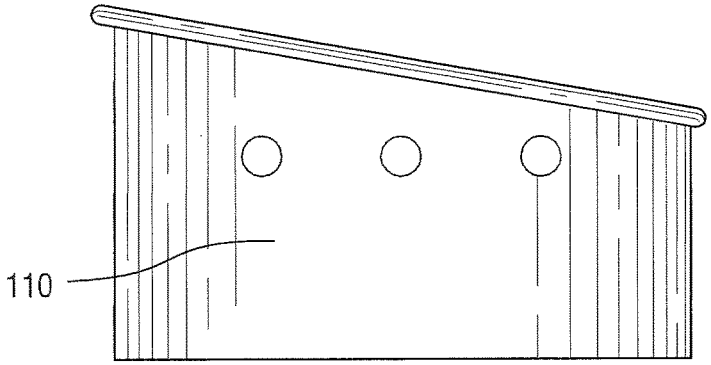
FIG. 25 shows a side plan view of a manifold housing of a preferred stave of the present disclosure having an external manifold.

FIGS. 11-12 illustrate another preferred embodiment of a stave/brick construction 59 of the present disclosure comprising stave 60 and alternating shallow and deep dovetail bricks 68 and 69, respectively, including top line stave brick 67 which preferably has the same depth as a long brick 69 and an exposed face 75 of greater height than the exposed faces 76 of the other shallow and deep dovetail bricks 68 and 69. As shown, both shallow and deep dovetail bricks 68 and 69 have upper and lower dovetail or oblique sections 73 and 74, respectively. Further, each of the bricks 67, 68 and 69 defines two brick corners 71 while deep bricks 69 define two concave brick vertexes 70 that match up with the brick corners 71 of shallow bricks 68 upon completion of the stave/brick construction 59 of the present disclosure. Stave 60 preferably comprises a plurality of stave ribs 64 and a stave socle (not shown) to support stave 60 in a standing position which may be a fully upright 90 degrees, or a tilted or slanted position.

Each stave rib 64 preferably defines generally angular upper and lower rib edges 65 and 66, respectively. Stave 60 preferably defines a plurality stave channels 61 between each successive pair of stave ribs 64. Preferably, each stave channel 61 comprises a generally planar stave channel wall 77, although stave channel wall 77 may also be curved or contoured along its vertical and/or horizontal axes, toothed, etc., to be complementary with the front faces 78 of the deep dovetail bricks 69 if such front face 78 has a shape other than the planar shape depicted herein, which may depend upon the application. Each stave channel 61 also preferably includes a generally dovetail-shaped upper channel section 62 and a generally dovetail-shaped lower channel section 63, all as defined by stave 60 and a successive pair of stave ribs 64.

The shapes, geometries and/or cross-sections of one or more of the stave ribs 64, upper and lower rib edges 65 and 66, stave channels 61, stave channel walls 77, upper channel sections 62, lower channel sections 63, brick vertexes 70 and brick edges 71, upper and lower dovetail sections 73 and 74, exposed faces 75 and 76 and front faces 78 preferably may be modified or take other forms such as being contoured, angular, rectilinear, polygonal, geared, toothed, symmetrical, asymmetrical or irregular instead the shapes of the preferred embodiments thereof as shown in the drawings hereof with out departing from the scope of the present disclosure.

The view of stave/brick construction 59 of the present disclosure in FIG. 12 shows that every other one 79 of stave ribs 64 is preferably shortened by less than half the thickness (i.e., width) of bricks 67, 68 and 69, that is by: ((brick thickness−designed gap length between the staves or coolers)/2)+¼" for construction deviation. An additional brick (not shown), preferably of higher thermal conductivity to promote cooling similar to that of the stave/cooler 60, would be installed in place of the missing section of stave rib 64 to fill the void 80. Such stave/brick construction 59 allows the bricks 67, 68 and 69 to be inserted into and/or removed from stave channels 61, after stave 60 has been installed in the furnace, by sliding such bricks into stave channels 61 via voids 80, i.e., the extra room created by shortened stave ribs 79.

The stave/brick construction 59 may preferably employ a single brick design (not shown) or the alternating shallow and deep bricks 68 and 69, respectively, as shown in FIG. 11 wherein the dovetail sections 73 and 74 of deep bricks 69 are inserted and received into stave channels 61, each of the front faces 78 of shallow bricks 68 is disposed substantially near and/or adjacent to a respective face 81 of a stave rib 64 with or without such front face 78 being in partial or complete contact with its respective rib face 81, and each of the brick edges 71 of shallow bricks 68 is disposed substantially near and/or adjacent to a respective vertex 70 of a deep brick 69 with or without such brick edge 71 being in partial or complete contact with its respective vertex 70 of a deep brick 69. Additionally, other stave/brick constructions employing bricks of two or more different shapes with a portion of all such bricks being received in a stave channel is within the scope of the present disclosure.

The stave/brick constructions of the present disclosure preferably also may be assembled initially by setting the bricks in a form and casting the stave around the bricks.

As shown in FIGS. 13-27, stave 100 of the present disclosure comprises an outer housing 102 defining a plurality of stave channels 137 similarly to the embodiments described above. Stave 100 is identical to stave 30 described above except for the differences set forth below with respect to a preferred internal coolant or heat exchanging pipe circuit 104 disposed within stave outer housing 102 and associated inlets and outlets housed in external manifold 106.

As shown in FIGS. 13-27, stave 100 comprises outer housing 102, internal heat exchanging pipe or tubing circuit 104 comprising water or coolant fluid source and return pipes 108 (or tubes or hoses as preferred) having inlet and outlet ends housed in manifold 106, wherein manifold 106 preferably extends through to the outside of furnace shell 51 when stave 100 is installed inside furnace shell 51. Manifold 106 preferably comprises a hollow manifold housing 110 for receiving ends of circuit piping 108 and flanged couplings 114 which preferably are welded or otherwise brazed or fastened to both and end of a circuit pipe 108 disposed in manifold 106 and an outer surface or top plate 116 of manifold housing 110.

Manifold housing 110 preferably is made from opposing bent plates 120 of carbon steel welded together by fillet welds 122. A center plate support 124 and cross supports 126 provide additional strength and partition the large opening of the manifold housing 100 into smaller openings 128, each of which may receive an end of a circuit pipe 108. Preferably when the stave housing 102, preferably of copper, is cast over pipe circuit 104, manifold 106 is in place on the pipe circuit ends 108 so that copper fills in the openings 128 where the ends of pipes 108 are disposed to provide improved heat exchanging performance in transferring heat from the stave 100 into the coolant fluid in pipes 108, but also to better secure ends of pipes 108 in manifold 106. While manifold 106 is preferably made from carbon steel, it may alternately be made from any suitable material, such as stainless steel, cast iron, copper, etc.

Stave 100 has many advantages over conventional staves, such as: (1) stave 100 provides for ease of installation since it reduces the number of access holes or apertures required in the furnace shell 51 necessary for the inlet/outlet piping 108 to and from stave 100 through furnace shell 51; (2) stave 100 is of a very strong construction to provide much of the support necessary for installation of the stave 100 on furnace shell 51; (3) effects of stave expansion/contraction due to temperature changes in the furnace are minimized since individual pipe connections to furnace shell have been eliminated; (4) stave 100 reduces weld breaches in pipe connections with furnace shell 51 since such connections have been eliminated; (5) stave 100 reduces the importance/criticality of any support bolts needed to help support stave 100 on furnace shell 51 since such bolts are no longer relied upon to independently support stave 100 since manifold 106 carries much of the load required to support stave 100 on furnace shell 51.

Figure 26:
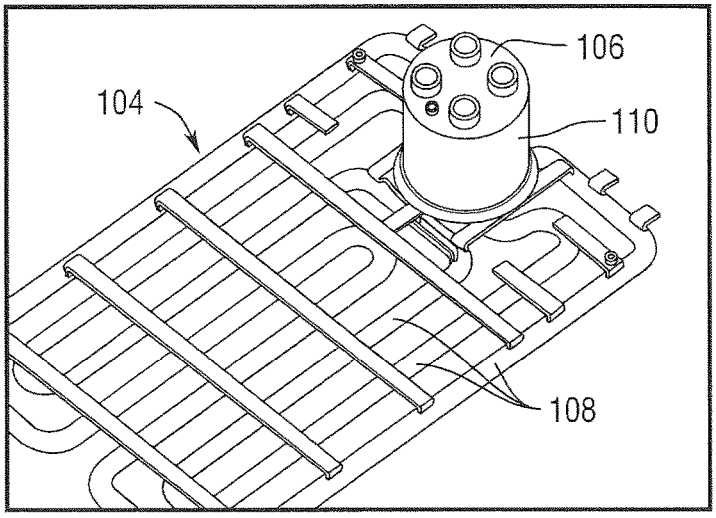
FIG. 26 shows an expanded, rear perspective view of a preferred stave of the present disclosure having a cylindrical external manifold.
Figure 27:
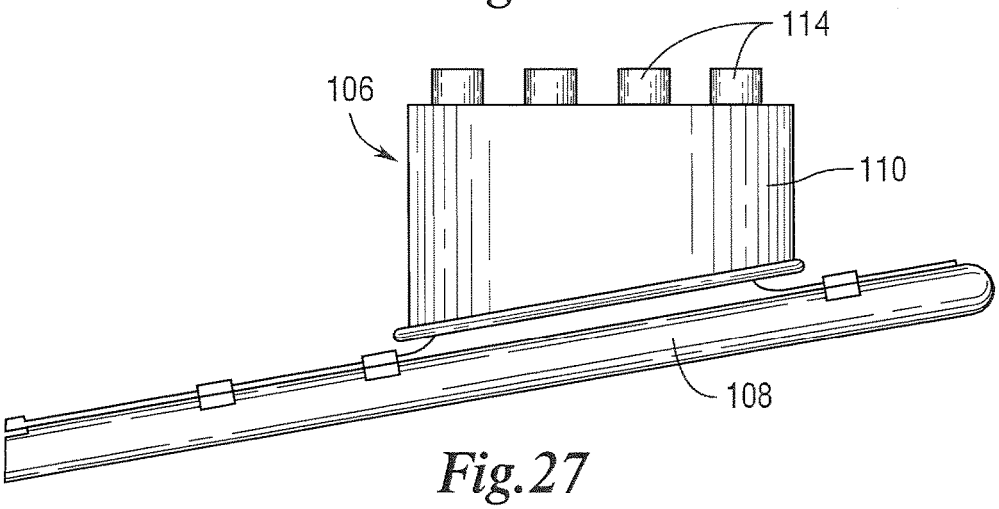
FIG. 27 shows a side plan view of a preferred internal coil assembly for a preferred stave of the present disclosure having an external manifold.

As shown in the drawings particularly FIG. 26, manifold 106 may take different and various shapes and sizes as needed.

In the foregoing Detailed Description, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A stave comprising an outer housing an inner pipe circuit comprising one or more individual pipes, wherein the one or more individual pipes are housed within the outer housing, wherein each of the one or more individual pipes has an inlet end and an outlet end, and wherein each of the one or more individual pipes may or may not be mechanically connected to another one of the one or more individual pipes; and a manifold comprising a manifold housing, wherein the manifold is integral with or disposed on or in the outer housing and wherein the manifold housing comprises a perimeter wall having a height and defining an opening;

wherein both of the inlet end and the outlet end of each of the one or more individual pipes are disposed in or housed by the same manifold and wherein both of the inlet end and the outlet end of each of the one or more individual pipes is surrounded at least in part by cast material provided within the opening of the manifold housing to help secure the inlet end and the outlet end of each of the one or more individual pipes to the manifold; and wherein the height of the perimeter wall of the manifold housing extends away from the outer housing and the inner pipe circuit.

2. The stave of claim 1 wherein the manifold is made of carbon steel and the outer housing is made of copper.

3. The stave of claim 1 wherein the cast material comprises copper, steel or stainless steel.

4. The stave of claim 1 wherein the stave has a plurality of ribs and a plurality of channels, wherein a front face of the stave defines a first opening into each of the channels; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated.

5. The stave of claim 4 wherein the stave defines one or more side openings into each of the channels.

6. The stave of claim 4 wherein said one or more portions of the brick comprises a nose at least partially disposed in a first section of the one channel.

7. The stave of claim 6 wherein the first section is complementary to the nose.

8. The stave of claim 4 wherein the rotation of the brick comprises a bottom of the brick moving in a direction towards the stave.

9. The stave of claim 4 wherein a first rib surface of the first rib is complementary to a groove defined by a top of the brick and wherein the first rib surface is at least partially disposed in the groove.

10. The stave of claim 4 wherein each of the plurality of bricks can be removed from its respective channel via rotation of each brick comprising a bottom of each brick moving in a direction away from the stave.

11. The stave of claim 4 wherein the stave is substantially flat.

12. The stave of claim 4 wherein the stave is curved with respect to one or both of a horizontal axis and a vertical axis.

13. The stave of claim 4 wherein the plurality of bricks at least partially disposed in the plurality of channels form a plurality of stacked, substantially horizontal rows of bricks protruding from the front face of the stave.

14. The stave of claim 13 wherein one of the bricks cannot be pulled and/or rotated out of the first opening of its respective channel when another brick is disposed in the row above and partially or completely covers the one brick.

15. The stave of claim 4 comprising a plurality of staves standing side-by-side with gaps between adjacent staves; wherein each stave has a plurality of ribs, a plurality of channels, and a plurality of substantially horizontal rows of bricks disposed in the plurality of channels.

16. The stave of claim 15 wherein the plurality of substantially horizontal rows of bricks disposed in the plurality of channels covers, in-whole or in-part, the gaps between adjacent staves.

17. The stave of claim 15 wherein the staves stand substantially vertically or at an angle other than about 90 degrees.

18. The stave of claim 4 wherein each of the plurality of bricks further defines a seat wherein the seat is at least partially disposed in a second section of the one channel.

19. The stave of claim 18 wherein the second section is complementary to the seat.

20. A stave comprising:

a stave housing a stave cooling fluid circuit comprising one or more individual pipes disposed in or defined by the stave housing, wherein each of the one or more individual pipes has an inlet end and an outlet end;

a stave cooling fluid inlet in fluid communication with the stave cooling fluid circuit and a stave cooling fluid outlet in fluid communication with the stave cooling fluid circuit; and a manifold integral with or disposed on or in the stave housing, the manifold comprising a perimeter wall having a height and defining an opening, wherein the height of the perimeter wall of the manifold extends away from the stave cooling fluid circuit and a face of the stave housing and is configured for insertion through a shell of a furnace to provide support for installation of the stave on the shell wherein both of the inlet end and the outlet end of each of the one or more individual pipes are disposed in or housed by the same manifold, wherein the inlet end of each of the one or more individual pipes is configured for providing cooling fluid to the stave cooling fluid circuit, and wherein the outlet end of each of the one or more individual pipes is configured for receiving cooling fluid from the stave cooling fluid circuit, and wherein both of the inlet end and the outlet end of each of the one or more individual pipes is surrounded at least in part by cast material within the opening of the manifold to help secure the inlet end and the outlet end of each of the one or more individual pipes to the manifold.

* * * * *